US006059897A

United States Patent [19]

Koerner et al.

[11] Patent Number: 6,059,897

[45] Date of Patent: May 9, 2000

[54] SHORT-TERM HEAT-SEALING OF ANODIZED METAL SURFACES WITH SURFACTANT-CONTAINING SOLUTIONS

[75] Inventors: Torsten Koerner, Duesseldorf; Josef Kresse, Rommerskirchen, both of Germany

[73] Assignee: Henkel Kommanditgesellschaft auf Aktien, Duesseldorf, Germany

[21] Appl. No.: 09/194,391

[22] PCT Filed: May 22, 1997

[86] PCT No.: PCT/EP97/02620

§ 371 Date: Nov. 30, 1998

§ 102(e) Date: Nov. 30, 1998

[87] PCT Pub. No.: WO97/46738

PCT Pub. Date: Dec. 11, 1997

[30] Foreign Application Priority Data

May 31, 1996 [DE] Germany ..... 196 21 818

[51] Int. Cl.[7] ..... C23C 22/82

[52] U.S. Cl. ..... 148/272; 148/274; 148/275; 148/276

[58] Field of Search ..... 148/271, 272, 148/274, 275, 276; 205/203, 204

[56] References Cited

U.S. PATENT DOCUMENTS

| | | | |
|---|---|---|---|
| 3,257,244 | 6/1966 | Fredrik et al. | 148/272 |
| 3,900,370 | 8/1975 | Germscheid et al. | 204/38 A |
| 4,121,980 | 10/1978 | Gohausen et al. | 204/35 N |
| 4,445,983 | 5/1984 | Gohausen et al. | 204/35 N |
| 4,939,001 | 7/1990 | Brodalla et al. | 427/419.2 |
| 5,411,607 | 5/1995 | Basaly et al. | 148/272 |
| 5,478,415 | 12/1995 | Massad et al. | 148/272 |

FOREIGN PATENT DOCUMENTS

| | | | |
|---|---|---|---|
| 0 103 234 | 3/1984 | European Pat. Off. . | |
| 0 122 129 | 10/1984 | European Pat. Off. . | |
| 0 171 799 | 2/1986 | European Pat. Off. . | |
| 0 347 663 | 12/1989 | European Pat. Off. . | |
| 2 370 110 | 6/1978 | France . | |
| 22 11 553 | 9/1973 | Germany . | |
| 26 50 989 | 5/1978 | Germany . | |
| 38 20 650 | 12/1989 | Germany . | |
| 195 38 777 | 4/1997 | Germany . | |
| 548033 | 9/1942 | United Kingdom | 148/274 |
| 1 232 693 | 5/1971 | United Kingdom . | |

OTHER PUBLICATIONS

Ullmann's "Encyclopedia of Industrial Chemistry", 5th Ed., vol. 9, (1987), pp. 174–176.

R. Kniep, P. Lamparter and S. Steeb: "Structure of Anodic Oxide Coatings on Aluminum" Angew. Chem. Adv. Mater 101 (1989), pp. 975–977.

S. Wernick, R. Pinner and P.G. Sheasby: "The Surface Treatment and Finishing of Aluminum and it's Alloys", vol. 2, 5th Ed., Chapter 11: "Sealing Anodic Oxide Coatings".

DIN 50949.

DIN 50946.

*Primary Examiner*—George Wyszomierski
*Assistant Examiner*—Andrew L. Oltmans
*Attorney, Agent, or Firm*—Ernest G. Szoke; Wayne C. Jaeschke; Stephen D. Harper

[57] ABSTRACT

Process for post-sealing anodized metal surfaces, characterized in that the anodized metal is contacted with an aqueous solution for a period of between 0.5 and 2 minutes per micrometer of anodized coating thickness, which solution is at a temperature of between 75° C. and its boiling point and has a pH of from 5.5 to 8.5 and which contains:

(a) a total of 0.0004 to 0.05 g/l of one or more cationic, anionic or non-ionic surfactants; and (b) a total of 0.0005 to 0.5 g/l of one or more organic acids selected from cyclic polycarboxylic acids having 3 to 6 carboxyl groups and/or phosphonic acids.

Non-ionic surfactants are preferred as the surfactants while polyphosphinocarboxylic acids are preferred as the acids. Alkali and/or alkaline earth metal cations, preferably Li and/or Mg ions, are optionally present in quantities of 0.0001 to 5 g/l.

27 Claims, No Drawings

SHORT-TERM HEAT-SEALING OF ANODIZED METAL SURFACES WITH SURFACTANT-CONTAINING SOLUTIONS

FIELD OF THE INVENTION

This invention relates to the production of corrosion-inhibiting and/or decorative coatings on metals by anodic oxidation. It relates to an improved process for postsealing porous, electrochemically-produced anodized coatings in order further to improve the properties thereof.

TECHNICAL BACKGROUND AND RELATED ART

Electrochemical anodic oxidation of metals in suitable electrolytes is a widely used process for the formation of corrosion-inhibiting and/or decorative finishes on metals suitable for this purpose. These processes are briefly described in *Ullmann's Encyclopedia of Industrial Chemistry,* 5th edition, volume 9 (1987), pp. 175–176. According to this reference, titanium, magnesium and aluminum and alloys thereof are anodizable, the anodization of aluminum and alloys thereof being of the greatest industrial significance. The electrolytically produced anodized coatings protect the aluminum surfaces from the action of weathering and other corrosive media. Anodized coatings are also applied in order to create a harder surface, thus increasing the wear resistance of aluminum. Particular decorative effects may be achieved by means of the intrinsic color of the anodized coatings or by absorptive or electrolytic coloring. Aluminum is anodized in an acidic electrolyte, sulfuric acid being most commonly used. Other suitable electrolytes are phosphoric acid, oxalic acid and chromic acid. The properties of the anodized coatings may be varied widely by selection of the electrolyte, the temperature thereof and by the current density and duration of anodization. Anodization is conventionally performed using direct current or using direct current having a superimposed alternating current.

Freshly anodized coatings may subsequently be colored by immersion in solutions of a suitable dye or by an alternating current treatment in an electrolyte containing a metal salt, preferably containing tin. As an alternative to subsequent coloring, colored anodized coatings may be obtained by so-called color anodization processes, in which anodization is performed in solutions of organic acids, such as in particular sulfophthalic acid or sulfanilic acid, each optionally mixed with sulphuric acid.

These anodically-produced protective coatings, the structure of which has been scientifically investigated (R. Kniep, P. Lamparter and S. Steeb: "Structure of Anodic Oxide Coatings on Aluminium", *Angew. Chem. Adv. Mater.* 101 (7), pp. 975–977 (1989)), are frequently described as "oxide coatings". The above investigation has, however, demonstrated that these coatings are vitreous and contain tetrahedrally-coordinated aluminum. Octahedrally-coordinated aluminum, as in aluminum oxides, was not found. Herein, the more general term "anodized coatings" is used instead of the misleading term "oxide coatings".

However, these coatings do not yet fulfill all requirements with regard to corrosion protection, as they still have a porous structure. It is consequently necessary to post-seal the anodized coatings. This post-sealing is frequently performed using hot or boiling water, alternatively using steam, and is described as "sealing". This treatment seals the pores, thus considerably increasing corrosion protection. There are numerous literature references relating to this post-sealing process. The following may be mentioned by way of example: S. Wernick, R. Pinner and P. G. Sheasby: "The Surface Treatment and Finishing of Aluminum and its Alloys" (volume 2, 5th edition, Chapter 11: "Sealing Anodic Oxide Coatings"), ASM International (Metals Park, Ohio, U.S.A.) and Finishing Publications Ltd. (Teddington, Middlesex, England) 1987.

However, not only are the pores sealed during post-sealing of the anodized coating, but a velvety deposit of a greater or lesser thickness, the so-called "sealing deposit", is formed over the entire surface. This deposit, which consists of hydrated aluminum oxide, is visually unattractive, reduces adhesion when bonding such aluminum components and promotes subsequent soiling and corrosion. Since the subsequent manual removal of this sealing deposit by mechanical or chemical methods is costly, attempts have been made to prevent the formation of this sealing deposit by means of chemical additives in the sealing bath. According to DE C-26 50 989, additions of cyclic polycarboxylic acids having 4 to 6 carboxyl groups per molecule, in particular cyclohexane hexacarboxylic acid, are suitable for this purpose. According to DE-A-38 20 650, certain phosphonic acids, for example 1-phosphonopropane-1,2,3-tricarboxylic acid, may also be used. The use of other phosphonic acids is known from EP-A-122 129. DE-C-22 11 553 describes a process for post-sealing anodic oxide coatings on aluminum and aluminum alloys in aqueous solutions containing phosphonic acids or salts thereof and calcium ions, wherein the molar ratio of calcium ions:phosphonic acid is adjusted to at least 2:1. A higher ratio of calcium ions:phosphonic acids of about 5:1 to about 500:1 is preferably used. Phosphonic acids which may, for example, be considered are: 1-hydroxy-propane-, 1-hydroxy-butane-, 1-hydroxy-pentane-, 1-hydroxy-hexane-1,1-diphosphonic acid together with 1-hydroxy-1-phenyl-methane-1,1-diphosphonic acid and preferably 1-hydroxy-ethane-1,1-diphosphonic acid, 1-amino-ethane-, 1-amino-1-phenyl-methane-, dimethylamino-ethane-, dimethylamino-butane-, diethylaminomethane-, propyl- and butyl-aminomethane-1,1 -diphosphonic acid, aminotrimethylene-phosphonic acid, ethylene-diamine-tetramethylene-phosphonic acid, diethylene-triamine-pentamethylene-phosphonic acid, aminotri-(2-propylene-2-phosphonic acid), phosphonosuccinic acid, 1-phosphono-1-methylsuccinic acid and 2-phosphonobutane-1,2,4-tricarboxylic acid. On the basis of the practical examples of the said patent, this process is a conventional hot post-sealing process using post-sealing times of between 60 and 70 minutes at anodized coating thicknesses of between about 18 and about 22 $\mu$m. Post-sealing time is thus approximately 3 minutes per $\mu$m of coating thickness.

When using water which contains no additives other than the stated sealing deposit inhibitors, elevated temperatures (at least 90° C.) and relatively long treatment times of the order of about 1 hour for an anodized coating of about 20 $\mu$m have hitherto been necessary. This corresponds to a post-sealing time of about 3 minutes per micrometer of anodized coating thickness. The post-sealing process is thus highly energy intensive and, due to its duration, may act as a bottleneck in the production process. Attempts have thus already been made to find additives for the post-sealing bath which promote the post-sealing process, so that it may proceed at lower temperatures (so-called cold post-sealing or cold sealing) and/or using shorter treatment times. The following have, for example, been proposed as additives which facilitate post-sealing at temperatures of below 90° C.: nickel-salts, in particular fluorides, which are sometimes used in practice (EP 171 799); nitrosyl-pentacyanoferrate; complex fluorides of titanium and zirconium together with chromates or chromic acid, optionally in conjunction with further additives. As an alternative to actual post-sealing, hydrophobization of the oxide coating by means of long-chain carboxylic acids or waxes has been recommended, as has treatment with acrylamides, which should apparently be polymerized in the pore voids. Further details in this connection may be found in the above-mentioned reference by S. Wernick et al. With the exception of post-sealing using nickel compounds, it has not proved possible to implement these proposals in practice.

Processes for cold post-sealing using nickel fluoride have been implemented industrially, However, due to the toxic properties of nickel salts, this entails costly waste water treatment measures.

There is thus still a need for alternative post-sealing processes for anodized surfaces which make it possible to increase the rate of production by shortened post-sealing times and/or to reduce the energy consumption necessary for post-sealing, without using heavy metals, such as nickel, which are questionable on environmental and health grounds.

An accelerated, hot post-sealing process is known from U.S. Pat. No. 5,411,607 in which the anodized metal components are immersed in an aqueous solution containing lithium. The lithium concentration is preferably from 0.01 to 50 g/l, in particular from 0.01 to 5 g/l. It is moreover suggested that the sealing solution should additionally contain a sealing deposit inhibitor. This is preferably present in a concentration of between 0.1 and 10 g/l and is preferably an aromatic disulfonate. According to U.S. Pat. No. 5,478,415, which has the same priority as the above-mentioned U.S. Pat. No. 5,411,607, accelerated hot post-sealing may proceed using an aqueous solution which contains at least 0.01 g/l of lithium ions and 0.1 to 10 g/l of a sealing deposit inhibitor. Here too, the sealing deposit inhibitor is preferably an aromatic disulfonate.

German patent application 195 38 777.5 discloses an accelerated hot post-sealing process in which the anodized metal components are contacted with an anodizing solution which contains a total of 0.1 to 5 g/l of one or more alkali metal and/or alkaline earth metal ions and a total of 0.0005 to 0.2 g/l of a sealing deposit inhibitor in the form of phosphonic acids or cyclic polycarboxylic acids.

The teachings of the latter three cited documents allow hot post-sealing times to be shortened substantially. It would, however, be desirable on economic and environmental grounds to have post-sealing processes available which consume distinctly smaller quantities of chemicals. An object of the present invention is to provide such a process.

DESCRIPTION OF THE INVENTION

The present invention provides a process for post-sealing anodized metal surfaces, characterized in that the anodized metal is contacted with an aqueous solution for a period of between 0.5 and 2 minutes per micrometer of anodized coating thickness, which solution is at a temperature of between 75° C. and its boiling point and has a pH of from 5.5 to 8.5 and which contains:

(a) a total of 0.0004 to 0.05 g/l, preferably 0.005 to 0.02 g/l, of one or more cationic, anionic or non-ionic surfactants; and (b) a total of 0.0005 to 0.5 g/l of one or more organic acids selected from cyclic polycarboxylic carboxylic acids having 3 to 6 carboxyl groups and/or phosphonic acids.

The treatment solutions may be contacted with the anodized metals by spraying the solutions onto the metal surfaces or preferably by immersing the anodized metals in the solutions. At conventional industrial anodized coating thicknesses of approximately 20 $\mu$m, the treatment times required are still only 20 to 40 minutes. The temperature of the treatment solution is preferably from 94 to 98° C., preferably about 96° C.

The pH of the aqueous solution is preferably from 5.5 to 7, in particular from 5.5 to 6.5. The pH may, if necessary, be adjusted using ammonia or acetic acid. The pH may be maintained within the required range using an ammonium acetate buffer.

Cationic surfactants (a) may be selected, for example, from quaternary ammonium salts in which at least one alkyl or aralkyl moiety has at least 8 carbon atoms. One example of such a substance is $C_{12-14}$-alkyl-dimethyl-benzylammonium chloride. Pyridinium salts, such as dodecyl-pyridinium chloride, may also be used as cationic surfactants. Examples of anionic surfactants (a) which may be used are alkyl or aralkyl sulfates and sulfonates. In this case, linear alkyl sulfates, such as lauryl sulfate, are preferred for environmental reasons. The anionic surfactants are used as alkali metal or ammonium salts, lithium salts being particularly preferred. Preferably, however, non-ionic surfactants are used as the surfactants (a). These may be selected, for example, from alkoxylates, such as ethoxylates and/or propoxylates of fatty alcohols or fatty amines. For the present purposes, fatty alcohols and fatty amines are compounds having an alkyl moiety containing at least 8 carbon atoms. Such substances may be pure substances having a defined alkyl moiety or consist of product mixtures, such as are obtained from natural fats and oils. These alkoxylates may also be end-terminated, i.e. etherified again on the terminal OH group. Examples of such non-ionic surfactants are octanol×4 EO (EO=ethylene oxide) and octanol×4.5 EO-butyl ether. Better post-sealing results tend to be obtained if fatty amine ethoxylates, instead of fatty alcohol ethoxylates, are used as the non-ionic surfactants. Non-ionic surfactants (a) are thus preferably selected from fatty amine ethoxylates having 10 to 18 carbon atoms in the alkyl moiety and 3 to 15 ethylene oxide units per molecule. Specific examples are coconut oil fatty amine×5 EO and coconut oil fatty amine×12 EO.

In a specific embodiment, the organic acids (b) are selected from saturated, unsaturated or aromatic carbocyclic six-membered ring carboxylic acids having 3 to 6 carboxyl groups. Preferred examples of such acids are trimesic acid, trimellitic acid, pyromellitic acid, mellitic add and the particularly preferred cyclohexane-hexacarboxylic acid. The total quantity of carboxylic acids is preferably from 0.001 to 0.05 g/l.

The preferred cyclohexane-hexacarboxylic acid exists as various stereoisomers. As is known from DE-A-26 50 989, preferred cyclohexane-hexacarboxylic acids are those which have 5 carboxyl groups in cis position and 1 in trans position or 4 carboxyl groups in cis position and 2 in trans position.

In another specific embodiment, the organic acids (b) are selected from the phosphonic acids: 1-phosphonopropane-1,2,3-tricarboxylic acid, 1,1-diphosphono-propane-2,3-dicarboxylic acid, 1-hydroxy-propane-1,1-diphosphonic acid, 1-hydroxy-butane-1,1 -diphosphonic acid, 1-hydroxy-1-phenyl-methane-1,1-diphosphonic acid, 1-hydroxy-ethane-1,1-diphosphonicacid, 1-amino-ethane-1,1-diphosphonicacid, 1-amino-1-phenyl-methane-1,1-diphosphonic acid, dimethylamino-ethane-1,1-diphosphonic acid, propylamino-ethane-1,1-diphosphonic acid, butylamino-ethane-1,1-diphosphonic acid, aminotri (methylene-phosphonic acid), ethylene-diaminotetra (methylene-phosphonic acid), diethylene-triaminopenta (methylene-phosphonic acid), hexamethylene-diaminotetra-(methylene-phosphonic acid), n-propyliminobis(methylene-phosphonic acid), aminotri-(2-propylene-2-phosphonic acid), phosphonosuccinic acid, 1-phosphono-1-methyl-succinic acid and 1-phosphonobutane-1,2,4-tricarboxylic acid. Of this selection, 1-phosphonopropane-1,2,3-tricarboxylic acid, 1,1-diphosphonopropane-2,3-dicarboxylic acid and aminotri-(methylene-phosphonic acid) are particularly preferred. The phosphonic acids (b) are preferably used in a quantity of 0.003 to 0.05 g/l. Polyphosphinocarboxylic acids which may be considered as copolymers of acrylic acid and hypophosphites are also suitable. One example of such a compound is "Belclene® 500" from FMC Corporation, Great Britain.

It may, moreover, be advantageous for the effectiveness of post-sealing if the aqueous post-sealing solution additionally contains a total of 0.0001 to 5 g/l of one or more alkali metal and/or alkaline earth metal ions. These alkali metal or alkaline earth metal ions may be present as counter-ions to the acids (b). Preferably, however, the aqueous solution contains a larger quantity of alkali metal and/or alkaline earth metal ions than is required for complete neutralization of the acids (b). It is particularly preferred if these additional alkali metal and/or alkaline earth metal ions, which exceed the quantity required for complete neutralization of the acids (b), are selected from lithium and magnesium. In order to reduce the use of chemicals to a minimum, the content of the aqueous solution of these alkali metal and/or alkaline earth metal ions is generally limited to a maximum of 0.005 g/l. Higher contents, for example up to 5 g/l, do not, however, impair post-sealing results. These alkali metal and/or alkaline earth metal ions, in particular lithium and magnesium, may be used in the form of the salts thereof which are soluble in water in the stated range of concentrations. Anionic surfactants (a) may, for example, be used as the counter-ions. Acetates, lactates, sulfates, oxalates and/or nitrates are, for example, also suitable. Acetates are particularly suitable.

Particularly good post-sealing results are achieved if, immediately after the accelerated hot post-sealing described above, the metal surfaces are immersed in completely deionized water for a period of between 30 and 120 seconds, the water being at a temperature of above 90° C., preferably of above 96° C.

The post-sealing bath suitable for the post-sealing process according to the present invention may, in principle, be produced in situ by dissolving the constituents in (preferably completely deionized) water in the appropriate concentration range. Preferably, however, an aqueous concentrate already containing all the necessary constituents of the post-sealing bath in the correct quantity ratio is used, from which the ready-to-use solution is obtained by dilution with water, for example by a factor of between about 100 and about 1000. In so-doing, it may be necessary to adjust the pH to the range according to the present invention using ammonia or acetic acid. Accordingly, the present invention also relates to an aqueous concentrate for the preparation of the aqueous solution for use in the present accelerated hot post-sealing process, the concentrate yielding the ready-to-use aqueous solution by dilution with water by a factor of between about 100 and about 1000.

It is possible by using the accelerated and energy-saving process according to the present invention to produce post-sealed anodized coatings which, with regard to the coating properties thereof, are not inferior to conventionally produced coatings. Industrially significant test parameters for coating quality are, in particular, acid corrosion loss in chromic acid, admittance and the dye droplet test. These coating quality parameters are tested using the standard test methods indicated in the Examples.

The post-sealing process according to the present invention is preferably used for anodized aluminum or anodized aluminum alloys. It may, however, also be used on the anodized coatings of other anodizable metals, such as titanium and magnesium or alloys of these metals. It may be used both for uncolored anodized coatings and for those colored using conventional methods, such as self-coloring, adsorptive coloring using organic dyes, reactive coloring to form inorganic coloring pigments, electrochemical coloring using metal salts, in particular tin salts, or interference coloring. In the case of adsorptively colored anodized coatings, the process according to the present invention has the additional advantage that, due to the reduced duration of post-sealing, it is possible to reduce the bleeding of dye which is possible in conventional hot post-sealing.

EXAMPLES

Al 99.5 grade aluminum sheets were conventionally anodized (direct current/sulfuric acid, 1 hour, coating thickness 20 $\mu$m) and optionally colored electrochemically or using organic dip dyes. The sheets were then immersed for 30 minutes in the post-sealing solutions according to the present invention or comparison solutions according to the Table. To this end, 2 g of concentrate were in each case made up to 1 liter using completely deionized water. The solutions were at a temperature of 96° C. After treatment according to the Table, the sheets were immersed for 1 minute in boiling completely deionized water and then dried. The quality of post-sealing was then verified by the conventional quality tests described below. The results of these tests are also shown in the Table. They demonstrate that, using the process according to the present

TABLE

Test results

| Solution from | Admittance $Y_{20}$ ($\mu$S) | Residual reflection (%) | Acid corrosion loss (g/100 cm$^2$) |
|---|---|---|---|
| Comparison 1 | 27 | 98 | 24.1 |
| Example 1 | 19 | 100 | 12 |
| Example 2 | 20 | 99 | 15 |
| Example 3 | 19 | 99 | 13 |
| Example 4 | 16 | 100 | 9 |
| Example 5 | 18 | 100 | 12 |
| Example 6 | 18 | 100 | 10 |
| Example 7 | 21 | 98 | 16 |
| Example 8 | 18 | 100 | 12 |
| Example 9 | 20 | 99 | 14 |
| Example 10 | 22 | 98 | 24 |
| Example 11 | 23 | 98 | 20 |

invention, post-sealing results are obtained after only 30 minutes which experience has shown are obtained only after 1 hour using a conventional hot post-sealing bath. In contrast, the post-sealing results after a Y hour treatment using comparison solutions reveal inadequate quality.

Admittance $Y_{20}$ was determined according to German standard DIN 50 949 using an Anotest Y D 8.1 meter supplied by Fischer. The measuring system consists of two electrodes, one of which is conductively connected to the base material of the specimen. The second electrode is immersed in an electrolyte cell, which may be placed upon the coating to be tested. This cell takes the form of a rubber ring having an internal diameter of 13 mm and a thickness of 5 mm, the annular surface of which is self-adhesive. The measurement area is 1.33 $cm^2$. A potassium sulfate solution (35 g/l) in completely deionized water is used as the electrolyte. The admittance value read from the meter is converted, in accordance with the instructions of DIN 50 949, to a measurement temperature of 25° C. and a coating thickness of 20 $\mu$m. The resultant values, which should preferably be between about 10 and about 20 $\mu$S, are shown in the Table.

Residual reflection after coloring with dye pursuant to German standard DIN 50 946 is measured as a parameter which reveals open-pored and thus poorly post-sealed coatings. The measurement area was delimited using a self-adhesive measurement cell from the previously-described Anotest device. The test area is wetted using an acid solution (25 ml/l sulfuric acid, 10 g/l KF). After exactly 1 minute, the acid solution is washed off and the test area dried. The test area is then wetted with dye solution (5 g/l of Sanodal blue) which is left to act on the surface for 1 minute. After rinsing under running water, the measurement cell is removed. Any dye loosely adhering to the dyed test surface is removed by rubbing with a mild powdered cleaner. Once the surface has been dried, a relative reflection measurement is made by placing the measuring head of light reflection meter (Micro Color supplied by the company Dr. Lange) once on an uncolored area of the surface and secondly on the dyed measurement surface. Residual reflection in % is obtained by multiplying the quotient of the measured value for the colored surface divided by the measured value of the uncolored surface by 100. Residual reflection values of between 95 and 100% indicate good post-sealing quality, while values of less than 95% are considered unacceptable. The higher the residual reflection value, the higher is the post-sealing quality. The values found are shown in the Table.

Acid corrosion loss is also measured according to ISO 3210. To this end, the test sheet is weighed to an accuracy of 0.1 mg and then immersed for 15 minutes at 38° C. in an acid solution containing 35 ml of 85% phosphoric acid and 20 g of chromium(VI) oxide per liter. On completion of the test period, the specimen is rinsed with deionized water and dried for 15 minutes at 60° C. in a drying cabinet. The specimen is then re-weighed. The difference in weight between the first and second weighings is calculated and divided by the size of the surface in $dm^2$. Weight loss is expressed as $\Delta G$ in $mg/dm^2$ ($1\ dm^2 = 100\ cm^2$) and should not exceed 30 $mg/dm^2$.

The following concentrates for comparison solutions and treatment solutions according to the present invention were prepared by dissolving the active ingredients in completely deionized water:

Comparison 1

25 g/l of polyphosphinocarboxylic acid solution (45 wt. % in water) (Acrylic acid/sodium hypophosphite copolymer, "Belclene® 500", FMC Corporation, Great Britain)

Example 1

As Comparison 1, plus: 10 g/l of coconut amine×5 EO

Example 2

As Comparison 1, plus: 10 g/l of coconut amine×12 EO

Example 3

As Comparison 1, plus: 5 g/l of coconut amine×5 EO

Example 4

As Comparison 1, plus: 10 g/l of coconut amine×5 EO 2 g/l of magnesium acetate

Example 5

As Comparison 1, plus: 10 g/l of coconut amine×5 EO 0.5 g/l of magnesium acetate Example 6

As Comparison 1, plus: 10 g/l of coconut amine×12 EO 2 g/l of lithium acetate

Example 7

As Comparison 1, plus: 2 g/l of coconut amine×5 EO

Example 8

As Comparison 1, plus: 15 g/l of coconut amine×5 EO

Example 9

As Comparison 1, plus: 5 g/l of octanol×4 EO

Example 10

As Comparison 1, plus: 5 g/l of Li lauryl sulfate

Example 11

As Comparison 1, plus: 5 g/l of lauryl-dimethyl-benzylammonium chloride

For the tests, 2 g of concentrate were made up to 1 liter with completely deionized water.

The invention claimed is:

1. A process for postsealing an anodized metal surface wherein the anodized metal surface is brought into contact with an aqueous sealing solution for a period of between 0.5 and 2 minutes per micrometer of anodized coating thickness, said aqueous sealing solution being at a temperature between 75° C. and its boiling point during its contact with the anodized metal surface, having a pH value in a range from 5.5 to 6.5 and comprising water and:

a) a total of 0.0004 to 0.05 g/l of one or more surfactants selected from the group consisting of:
   (a.1) alkyl and alkylaryl sulfates and sulfonates; and
   (a.2) alkoxylates of fatty alcohols and fatty amines having an alkyl moiety with at least 8 C atoms; and b) a total of 0.0005 to 0.5 g/l of one or more organic acids selected from the group consisting of
   (b.1) cyclic polycarboxylic acids having 3 to 6 carboxyl groups and
   (b.2) phosphonic acids.

2. A process as claimed in claim 1, wherein the aqueous sealing solution is at a temperature in the range from 94 to 98° C. during its contact with the anodized metal surface.

3. A process as claimed in claim 1, wherein the surfactants are selected from the group consisting of fatty amine ethoxylates having 10 to 18 C atoms in an alkyl moiety and 3 to 15 ethylene oxide units per molecule.

4. A process as claimed in claim 1, wherein the organic acids are selected from saturated, unsaturated or aromatic carbocyclic six-membered ring carboxylic acids having 3 to 6 carboxyl groups.

5. A process as claimed in claim 4, wherein the carboxylic acids are selected from the group consisting of trimesic acid, trimellitic acid, pyromellitic acid, mellitic acid and cyclohexanehexacarboxylic acid.

6. A process as claimed in claim 5, wherein the aqueous sealing solution contains the carboxylic acids in a total quantity of 0.001 to 0.05 g/l.

7. A process as claimed in claim 1, wherein the organic acids are selected from the group consisting of 1-phosphonopropane-1,2,3-tricarboxylic acid, 1,1-diphosphonopropane-2,3-dicarboxylic acid, 1-hydroxypropane-1,1-diphosphonic acid, 1-hydroxybutane-1,1-diphosphonic acid, 1-hydroxy-1-phenylmethane-1,1-diphosphonic acid, 1-hydroxyethane-1, 1-diphosphonic acid, 1-aminoethane-1,1 -diphosphonic acid, 1-amino-1-phenylmethane-1,1-diphosphonic acid, dimethylaminoethane-1,1-diphosphonic acid, propylaminoethane-1,1-diphosphonic acid, butylaminoethane-1,1-diphosphonic acid, aminotri (methylenephosphonic acid), ethylenediaminotetra (methylenephosphonic acid), diethylenetriaminopenta (methylenephosphonic acid), hexamethylenediaminotetra (methylenephosphonic acid), n-propyliminobis (methylenephosphonic acid), aminotri-(2-propylene-2-phosphonic acid), phosphonosuccinic acid, 1-phosphono-1-methylsuccinic acid, 1-phosphonobutane-1,2,4-tricarboxylic acid and polyphosphinocarboxylic acids.

8. A process as claimed in claim 7, wherein the organic acid is selected from polyphosphinocarboxylic acids.

9. A process as claimed in claim 1, wherein the aqueous sealing solution contains a larger total of alkali metal and alkaline earth metal ions than is required for complete neutralization of the acids of group b).

10. A process for postsealing an anodized metal surface according to claim 1, wherein, after completion of contact between the metal surface and the aqueous sealing solution, the metal surface is immersed for a period of between 30 and 120 seconds in completely deionized water, which is at a temperature of above 90° C.

11. A process according to claim 6, wherein the surfactants are selected from the group consisting of fatty amine ethoxylates having 10 to 18 C atoms in an alkyl moiety and 3 to 15 ethylene oxide units per molecule and are present in the aqueous sealing solution in a concentration from 0.005 to 0.02 g/l.

12. A process according to claim 11 wherein, after completion of contact between the metal surface and the aqueous sealing solution, the metal surface is immersed for a period of between 30 and 120 seconds in completely deionized water, which is at a temperature of above 90° C.

13. A process according to claim 3, wherein:

the surfactants are present in the aqueous sealing solution in a concentration from 0.005 to 0.02 g/l; and the organic acid is selected from the group consisting of polyphosphinocarboxylic acids and is present in the aqueous/sealing solution in a concentration from 0.003 to 0.05 g/l.

14. A process according to claim 13 wherein, after completion of contact between the metal surface and the aqueous sealing solution, the metal surface is immersed for a period of between 30 and 120 seconds in completely deionized water, which is at a temperature of above 90° C.

15. The process of claim 1 wherein the anodized metal surface is comprised of aluminum.

16. A process for postsealing an anodized metal surface wherein the anodized metal surface is brought into contact with an aqueous sealing solution for a period of between 0.5 and 2 minutes per micrometer of anodized coating thickness, said aqueous sealing solution being at a temperature between 75° C. and its boiling point during its contact with the anodized metal surface, having a pH value in a range from 5.5 to 6.5, and comprising water and:

a) a total of 0.0004 to 0.05 g/l of one or more surfactants selected from the group consisting of:

(a.1) quaternary ammonium salts, in which there is at least one alkyl or arylalkyl moiety that comprises at least 8 C atoms;

(a.2) pyridinium salts;

(a.3) alkyl and alkylaryl sulfates and sulfonates; and (a.4) alkoxylates of fatty alcohols and fatty amines having an alkyl moiety with at least 8 C atoms; and b) a total of 0.0005 to 0.5 g/l of one or more organic acids selected from the group consisting of (b.1) cyclic polycarboxylic acids having 3 to 6 carbaxyl groups and (b.2) phosphonic acids;

wherein the aqueous sealing solution contains a larger total of alkali metal and alkaline earth metal ions than is required for complete neutralization of the acids of group b).

17. A process as claimed in claim 16, wherein the aqueous sealing solution contains a total of not more than 0.005 g/l of alkali metal and alkaline earth metal ions, each of said alkali metal and alkaline earth metal ions being a lithium or a magnesium ion.

18. A process according to claim 16, wherein:

the surfactants are selected from the group consisting of fatty amine ethoxylates having 10 to 18 C atoms in an alkyl moiety and 3 to 15 ethylene oxide units per molecule and are present in the aqueous sealing solution in a concentration from 0.005 to 0.02 g/l; and the organic acid is selected from the group consisting of polyphosphinocarboxylic acids and is present in the aqueous sealing solution in a concentration from 0.003 to 0.05 g/l.

19. A process according to claim 18 wherein, after completion of contact between the metal surface and the aqueous sealing solution, the metal surface is immersed for a period of between 30 and 120 seconds in completely deionized water, which is at a temperature of above 90° C.

20. The process of claim 16 wherein the anodized metal surface is comprised of aluminum.

21. A process for postsealing an anodized metal surface wherein the anodized metal surface is brought into contact with an aqueous sealing solution for a period of between 0.5 and 2 minutes per micrometer of anodized coating thickness, said aqueous sealing solution being at a temperature between 75° C. and its boiling point during its contact with the anodized metal surface, having a pH value in a range from 5.5 to 6.5, and comprising water and:

a) a total of 0.0004 to 0.05 g/l of one or more surfactants selected from the group consisting of:

(a.1) quaternary ammonium salts, in which there is at least one alkyl or arylalkyl moiety that comprises at least 8 C atoms;

(a.2) pyridinium salts;

(a.3) alkyl and alkylaryl sulfates and sulfonates; and (a.4) alkoxylates of fatty alcohols and fatty mines having an alkyl moiety with at least 8 C atoms; and b) a total of 0.0005 to 0.5 g/l of one or more polyphosphonic carboxylic acids.

22. A process as claimed in claim 21, wherein the aqueous sealing solution contains the polyphosphinocarboxylic acids in a quantity of 0.003 to 0.05 g/l.

23. A process according to claim 21, wherein the surfactants are selected from the group consisting of fatty amine ethoxylates having 10 to 18 C atoms in an alkyl moiety and 3 to 15 ethylene oxide units per molecule and are present in the aqueous sealing solution in a concentration from 0.005 to 0.02 g/l.

24. A process according to claim 23 wherein, after completion of contact between the metal surface and the aqueous sealing solution, the metal surface is immersed for a period of between 30 and 120 seconds in completely deionized water, which is at a temperature of above 90° C.

25. The process of claim 21 wherein the anodized metal surface is comprised of aluminum.

26. A process for postsealing an anodized metal surface comprising the steps of 1) bringing the anodized metal surface into contact with an aqueous sealing solution for a period of between 0.5 and 2 minutes per micrometer of anodized coating thickness, said aqueous sealing solution being at a temperature between 75° C. and its boiling point during its contact with the anodized metal surface, having a pH value in a range from 5.5 to 6.5, and comprising water and:

a) a total of 0.0004 to 0.05 g/l of one or more surfactants selected from the group consisting of:

(a.1) quaternary ammonium salts, in which there is at least one alkyl or arylalkyl moiety that comprises at least 8 C atoms;

(a.2) pyridinium salts;

(a.3) alkyl and alkylaryl sulfates and sulfonates; and (a.4) alkoxylates of fatty alcohols and fatty amines having an alkyl moiety with at least 8 C atoms; and b) a total of 0.0005 to 0.5 g/l of one or more organic acids selected from the group consisting of (b.1) cyclic polycarboxylic acids having 3 to 6 carboxyl groups and (b.2) phosphonic acids; and (2) immersing the anodized metal surface for a period of between 30 to 120 seconds in completely deionized water which is at a temperature of above 90° C.

27. The process of claim 26 wherein the anodized metal surface is comprised of aluminum.

* * * * *

UNITED STATES PATENT AND TRADEMARK OFFICE

CERTIFICATE OF CORRECTION

PATENT NO. : 6,059,897
DATED : May 9, 2000
INVENTOR(S) : Koerner et al.

It is certified that error appears in the above-identified patent and that said Letters Patent is hereby corrected as shown below:

Column 9,
Line 18, delete “n-propyliminobis”, and insert therefor -- n-propyliminobis- --.
Line 51, delete “aqueous/sealing”, and insert therefor -- aqueous sealing --.

Column 10,
Line 12, delete “carbaxyl”, and insert therefor -- carboxyl --.
Line 55, delete “mines”, and insert therefor -- amines --.

Signed and Sealed this

Twenty-first Day of October, 2003

JAMES E. ROGAN
*Director of the United States Patent and Trademark Office*